US005301573A

United States Patent [19]

Weber et al.

[11] Patent Number: 5,301,573

[45] Date of Patent: Apr. 12, 1994

[54] STUD DRIVER AND REMOVER FOR STUDS HAVING NON-GRIP AREA

[75] Inventors: Edward J. Weber, Girard; Jerry L. Rounds, Erie, both of Pa.

[73] Assignee: Titan Tool Company, Fairview, Pa.

[21] Appl. No.: 34,706

[22] Filed: Mar. 19, 1993

Related U.S. Application Data

[63] Continuation-in-part of Ser. No. 24,296, Mar. 1, 1993, which is a continuation-in-part of Ser. No. 966,324, Oct. 26, 1992.

[51] Int. Cl.[5] ..... B25B 13/50

[52] U.S. Cl. ..... 81/53.2; 279/74

[58] Field of Search ..... 81/52, 53.2; 279/55, 279/74, 75

[56] References Cited

U.S. PATENT DOCUMENTS

| | | |
|---|---|---|
| 595,363 | 12/1897 | Bartlett . |
| 893,958 | 7/1908 | Weaver . |
| 1,068,263 | 7/1913 | Monaghan . |
| 1,162,197 | 11/1915 | Wahlstrom . |
| 1,594,515 | 1/1926 | Bruhn . |
| 1,898,726 | 6/1932 | Hess . |
| 2,063,344 | 3/1935 | Schneider . |
| 2,069,527 | 2/1937 | Kirkland . |
| 2,105,788 | 1/1938 | Hess . |
| 2,220,654 | 11/1940 | Kirkland . |
| 2,408,335 | 9/1946 | Oliver et al. . |
| 2,613,942 | 8/1947 | Saunders . |
| 3,889,557 | 6/1975 | Young . |
| 4,611,513 | 9/1986 | Young et al. . |
| 4,676,125 | 6/1987 | Ardelean . |
| 4,724,730 | 2/1988 | Mader et al. . |
| 4,932,292 | 6/1990 | Merrick . |
| 5,152,195 | 10/1992 | Merrick . |

FOREIGN PATENT DOCUMENTS

| | | |
|---|---|---|
| 3245896 | 10/1983 | Fed. Rep. of Germany . |
| 572552 | 10/1945 | United Kingdom . |

OTHER PUBLICATIONS

Titan Tool, Roll-Grip Stud Driver and Remover (Pamphlet).

*Primary Examiner*—James G. Smith

*Attorney, Agent, or Firm*—Oliff & Berridge

[57] ABSTRACT

A stud driver and remover for studs having non-grip areas includes an improved construction that enables the stud driver and remover to drive and remove studs without damaging a non-grip portion of the stud. The improved stud driver and remover includes five drive rolls, and increased ratio between the cross-sectional areas of the stud and the drive rolls. The stud driver and remover also includes an increased roll length and decreased included angle which allows the roll to penetrate more deeply into the stud. Each of a plurality of cams formed in a core of the tool is provided with a recess to accommodate one of the rolls. These recesses allow the tool to be placed on a stud having a non-grip area such as a flange or threaded area and to drive and remove the stud without damaging the non-grip area.

13 Claims, 7 Drawing Sheets

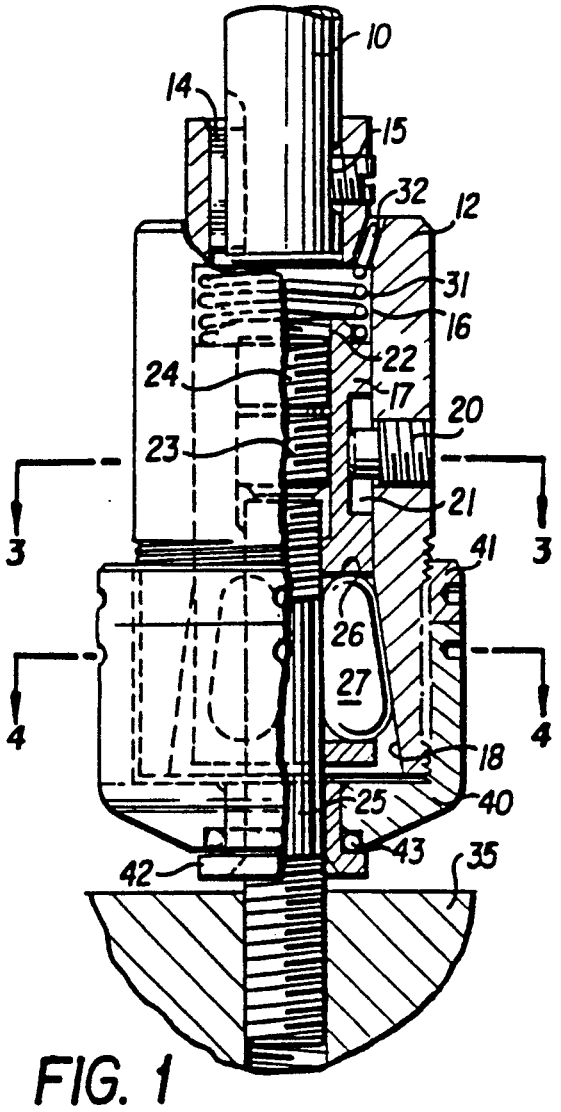
FIG. 1
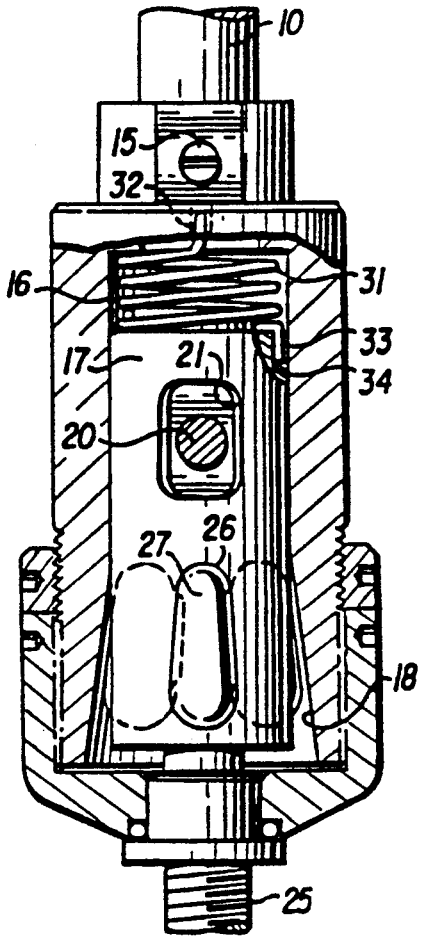
FIG. 2
FIG. 3
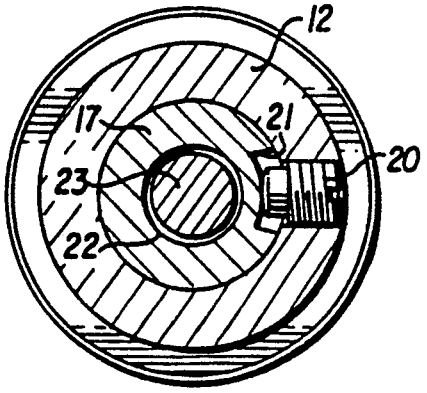
FIG. 4
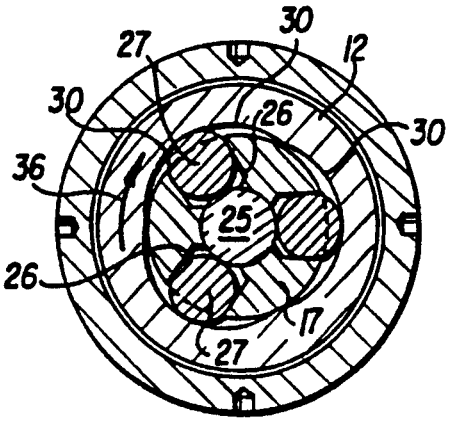

STUD DRIVER AND REMOVER FOR STUDS HAVING NON-GRIP AREA

CROSS REFERENCE TO RELATED APPLICATIONS

This application is a continuation-in-part application of commonly assigned U.S. patent application Ser. No. 08/024,296 filed on Mar. 1, 1993 by the inventors, which in turn is a continuation-in-part of commonly assigned U.S. patent application Ser. No. 07/966,324 filed on Oct. 26, 1992.

BACKGROUND OF THE INVENTION

1. Field of the Invention

The present invention relates to a stud driver and remover for studs having a non-grip area and a method of making the stud driver and remover. In particular, the present invention relates to a stud driver and remover for studs having an area that is susceptible to damage if gripped by the tool and a method of making the same in which the stud driver and remover has an improved construction over the prior art that enables the inventive stud driver and remover to drive and remove undercut studs without damaging the non-grip area.

2. Description of Related Art

Stud drivers and removers for small diameter studs are known. For example, U.S. Pat. No. 2,069,527 to Kirkland discloses a chuck adapted for stud driving and removing in which three relatively small rolls rotatably grasp the stud. In addition, the assignee of the present application has sold a stud driver and remover under the trademark ROLL-GRIP for studs having a diameter between three sixteenths and three inches. However, the ROLL-GRIP TM tool works best on small diameter studs, i.e., studs having a diameter between three sixteenths and three fourths of an inch. While these stud drivers and removers have worked very well for the small diameter studs, they are not readily adaptable to accommodate removal or driving of stud having a non-grip area such as a threaded portion or flange. An example of such a stud having a non-grip area is an undercut stud which has a relatively large diameter threaded portion and a relatively small diameter, non-threaded undercut portion.

These types of non-grip area studs and undercut studs, in particular, are used in many industries. Undercut studs are especially prevalent in most turbines used in various industries. The turbines require a large number of undercut studs which must be specially made for each application. Consequently, the undercut studs can cost as much as thousands of dollars each. In the past, there were no tools which could readily drive and remove the undercut studs without damaging the threads on the stud and rendering these studs useless. If a tool was available, the tool would flatten the threaded portion of the undercut stud during the driving or removal process, thereby rendering the undercut stud unusable and requiring a replacement undercut stud to be specially made. This results in undesired machine down time and unnecessary cost. Other studs having flanges or other areas not suitable to withstand the gripping pressures required for driving and removing experience similar difficulties with conventional stud driving and removing devices.

SUMMARY OF THE INVENTION

The present invention is directed to a stud driver and remover and a method of making the same which overcomes the problems of the prior art and accommodates driving and removing of studs having a non-grip area. The stud driver and remover constructed in accordance with the method of the present invention can drive and remove studs of any size without causing any damage to a non-grip area of the stud.

In accordance with the present invention, a tool driven by a driving adaptor for driving and removing a stud relative to a workpiece, comprises:

a main ring with an axial bore, one end of the bore being located adjacent the driving adaptor and the opposite end having an outwardly tapering section;

a core member mounted within the bore for limited axial and rotary movement relative to the main ring;

a plurality of tapered rolls carried by the core member and cooperating with the outwardly tapering section of the bore for frictionally engaging the stud upon axial movement of the core toward the one end of the bore and for releasing the stud upon axial movement of the core toward the opposite end of the bore;

a plurality of axially extending cam surfaces formed on the outwardly tapering section of the bore, wherein each of said plurality of cam surfaces is provided for a corresponding one of said plurality of rolls to lock each of said plurality of rolls against the stud upon rotation of the core member relative to the main ring in a radial direction; and a plurality of recesses, each of said plurality of recesses being formed in one of said cam surfaces to accommodate the corresponding one of said plurality of rolls.

Also in accordance with the present invention, a tool driven by a driving adaptor is formed by a method comprising the steps of:

providing a main ring with an inner diameter determined in accordance with a size of the stud to be driven and removed by said tool;

forming an axial bore in the main ring and an outwardly tapering section in the axial bore such that one end of the bore is located adjacent the driving adaptor and the outwardly tapering section is located at the opposite end;

mounting a core member within the bore for limited axial and rotary movement relative to the main ring;

forming a plurality of tapered rolls each having the diameter mounting the plurality of tapered rolls on said core member so that the rolls cooperate with the outwardly tapering section of the bore to frictionally engage the stud upon axial movement of the core toward the one end of the bore and to release the stud upon axial movement of the core toward the opposite end of the bore;

forming a plurality of cam surfaces on the outwardly tapering section of the bore, wherein each of said plurality of cam surfaces is provided for one of said plurality of rolls to lock the main ring and the stud upon rotation of the core member relative to the main ring; and forming a recess in each of said plurality of cam surfaces to allow each of said rolls to move radially outwardly when said rolls contact a larger diameter portion of a non-grip area of a stud.

BRIEF DESCRIPTION OF THE DRAWINGS

A preferred embodiment of the present invention will be described in detail in the following description, taken in conjunction with the following drawings in which like elements are denoted with like reference numerals, and wherein:

FIG. 1 is a side elevation, with parts being broken away and shown in sections, of a prior art non-undercut stud driver and remover;

FIG. 2 is a similar view of the mechanism shown in FIG. 1, the FIG. 2 view being taken at an angle of 90° with reference to the view of FIG. 1;

FIGS. 3 and 4 are sections taken along the lines 3—3 and 4—4 of FIG. 1;

DETAILED DESCRIPTION OF THE PREFERRED EMBODIMENT

Figure 5:
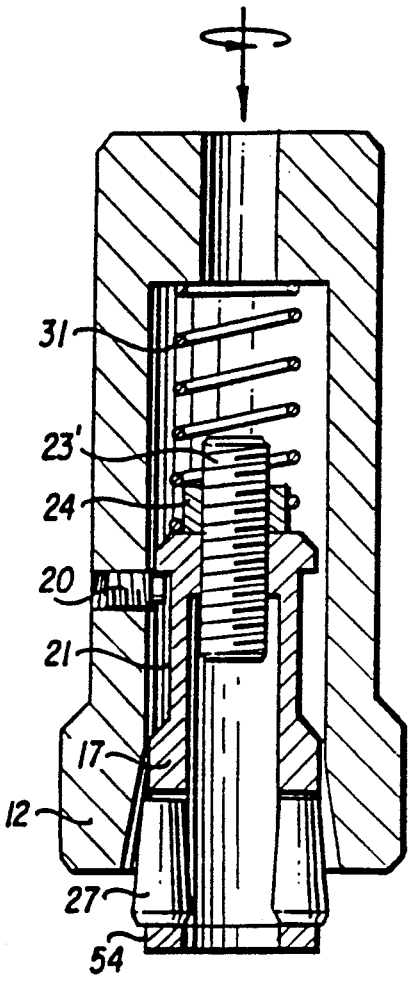
FIG. 5 is a schematic cross-sectional view showing the major components of the Titan Tool ROLL-GRIP TM stud driver and remover with the rolls disengaged from the main ring.

The invention will be described in detail with reference to the stud driver and remover described in U.S. Pat. No. 2,069,527 to Kirkland, the disclosure of which is hereby incorporated by reference. Further, the invention will be described with reference to the Titan Tool ROLL-GRIP TM stud driver and remover, which is described in Titan Tool Company's 1982 ROLL-GRIP brochure, the disclosure of which is hereby incorporated by reference.

The general structure and operation of the stud driver and remover corresponds to the prior art illustrated in FIGS. 1-6 but with the differences detailed below. A driving adapter 10 is non-rotatably connected to the main ring 12 of the stud driver and remover. The driving adapter 10 and the main ring 12 may be connected together by any appropriate means, such as the slot and key connection 14 or the set screw and flat connection 15. The main ring is provided with an axial bore 16 in which a core member 17 is reciprocally mounted. The open end of the bore 16 includes an outward taper 18. The main ring 12 and the core member 17 are preferably of cylindrical formation and are connected by means of a screw 20 and a slot 21, thereby permitting relative axial and rotary movements between the driving and core members. The slot 21 and screw 20 limit both the axial and rotary movements of the driving and core members relative to each other. The core member 17 is provided with a threaded axial bore 22 in which are mounted screw plugs 23, 24, the plug 23 serving as an adjustable stop adapted to engage the end of a stud 25 and the plug 24 serving to lock the plug 23 in its adjusted position within the core member 17.

Figure 6:
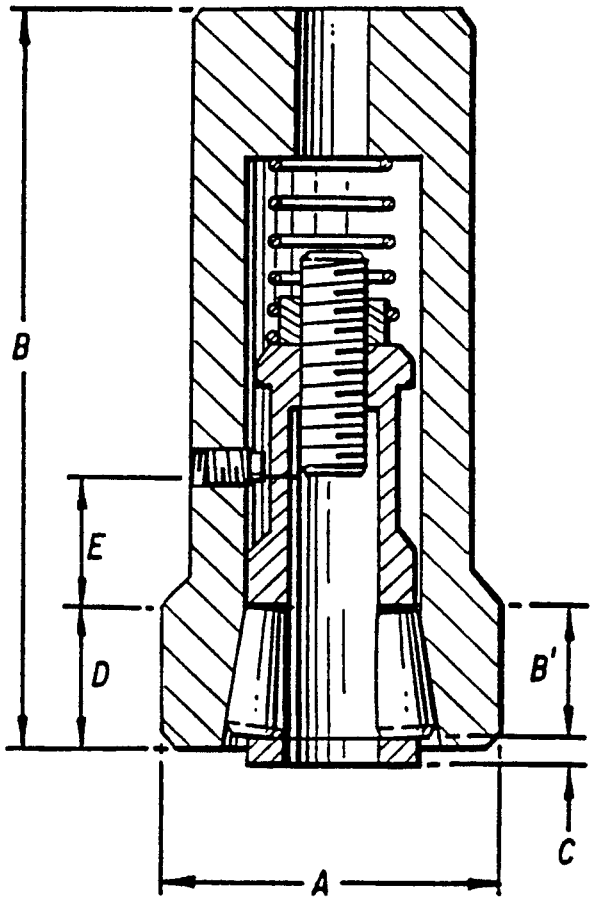
FIG. 6 is a schematic cross-sectional view showing the main components of the Titan Tool ROLL-GRIP TM with the rolls engaged in the main ring.

In the ROLL-GRIP TM stud driver and remover illustrated in FIGS. 5-6, the screw plugs 23, 24 are replaced by a core adjusting screw 23' and a lock nut 24'. The position of the core adjusting screw 23' is adjustable to set the depth to which the stud can enter the tool. The lock nut 24' locks the core adjusting screw 23' in its adjusted position. Also, in contrast to the prior art inventions, FIG. 5 illustrates that the drive square is located integrally in main ring 12.

In the prior art, the outer end of the core member 17 was provided with three axially directed slots 26 in which rolls 27 were disposed. The rolls 27 were tapered from end to end so as to contact over substantially their full length with the tapered, outwardly flared surface 18 of the main ring 12. As illustrated in FIG. 4, the outwardly flared portion 18 of the main ring 12 has cam surfaces 30 formed thereon which diverge radially outwardly at the central portion of each cam surface.

In operation, when the stud driver and remover is lowered over a stud 25 with the upper end of the stud abutting the adjustable stop plug 23 or core adjusting screw 23', the core member 17 is elevated to bring the rolls 27 into contact with the cam surfaces 30. The cam surfaces 30 on the main ring 12 curve radially inwardly with reference to the rolls 27 when the rolls 27 are centrally positioned with respect to the cam surfaces, so that movement of the main ring in a rotary direction either to the right or to the left relative to the roll 27 will move these rolls inwardly against the stud 25.

A helical spring 31 is disposed between the main ring 12 and the upper end of the core member 17. Preferably, one end 32 of the spring 31 is located in a suitable opening in the main ring 12 while the other end 33 of the spring is located in a suitable opening 34 in the core member 17. The spring 31 is compressed when assembled in position so that it normally urges the core member 17 outwardly relative to the main ring 12 so that the screw stop 20 is normally disposed in the upper end of the slot 21 when the chuck is not engaged on a stud.

To insert a stud, the tool is placed over the stud with the upper end of the stud abutting against the adjustable stop plug 23 or core adjusting screw 23' to elevate the core member 17 together with the rollers 27 until the rolls contact the cam surfaces 30 of the outwardly flared bore 18. The spring 31 has up to this time maintained the core member 17 and the rollers 27 in a lowered position with respect to the main ring 12 so that the rollers were out of contact with the cam surfaces 30 and free to move radially outwardly so that they would not exert any frictional gripping action upon the stud 25. However, as the upper end of the stud 25 causes elevation of the plug 23 (or core adjusting screw 23') and the core member 17, the rolls 27 are brought into contact with the cam surfaces 30 to cause initial frictional engagement therebetween. Since the main ring is being rotated in a clockwise direction as indicated by the arrow 36 in FIG. 4, the rolls 27 will be rotated in a corresponding direction and wedged between the cam surfaces 30 and the stud 25 so as to frictionally lock the main ring 12 to the stud and rotatably drive the stud into the work piece 35.

Continued rotation of the tool in the direction indicated rotatably threads the stud 25 into the workpiece 35. The tool is rotated until the stud 25 being driven or removed bottoms or shoulders out. To release the stud 25 from the tool, an operator pulls back on the tool and the rolls 27 separate to release the stud 25.

To adjust the position along the stud 25 at which the rolls 27 grip the stud, the tool is adjusted by turning the plug 23 or core adjusting screw 23' downwardly and locking it in position by means of the locking plug 24 or lock nut 24'. By adjusting the gripping position of the rolls, the operator can select where the rolls 27 will grip the stud along its axial length to avoid gripping of stud areas which are not suited for the gripping forces involved. In operation, the driving adapter 10 is rotated in the reverse direction with the tool being lowered over the stud so that the upper end of the stud contacts the abutment plug 23 or core adjusting screw 23' to elevate the core member 17 relative to the main ring 12 and to bring the rolls 27 into contact with the tapered bore 18. Rotation of the driving adapter 10 in the counterclockwise direction as viewed in FIG. 4, wedges the rolls 27 between the relatively stationary stud 25 and the oppositely sloping portions of the cam surfaces 30 so as to frictionally lock the stud with reference to the driving adapter 10. When the stud has been turned out of the workpiece 35, it is released from the tool by pulling it downwardly with reference to the main ring 12.

FIG. 5 illustrates a schematic cross-sectional view of the Titan Tool ROLL-GRIP TM with the rolls 27 disengaged from the main ring 12. FIG. 6 illustrates the Titan Tool ROLL-GRIP TM with the rolls engaged in the main ring in the position in which the rolls would grasp a stud (not shown in FIGS. 5–6). Readily available commercial versions of the ROLL-GRIP TM are available for stud diameters up to three inches, and larger sizes are available upon request. For a three inch diameter stud, the tool has an outside diameter A of 5.0 inches, a length B of 12 7/32 inches, and a weight of 34.6 pounds. Eleven rolls were used. The length B' of the rolls 27 is 0.845 inches including the tapers "t" at each end of the roll (see FIG. 7). If the tapers "t" are ignored, the roll length is 13/16 inches. The core cap width C is 0.25 inches. The minimum grip D to the top of the rolls 27 is 1 1/16 inches and the maximum area E above the rolls is 6⅛ inches.

Figure 7:
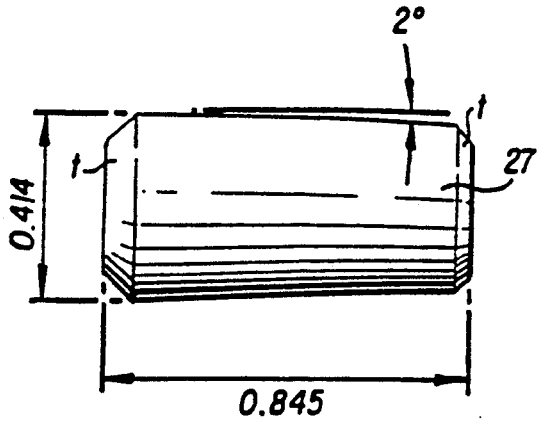
FIG. 7 is a side view of a prior art roll.
Figure 8:
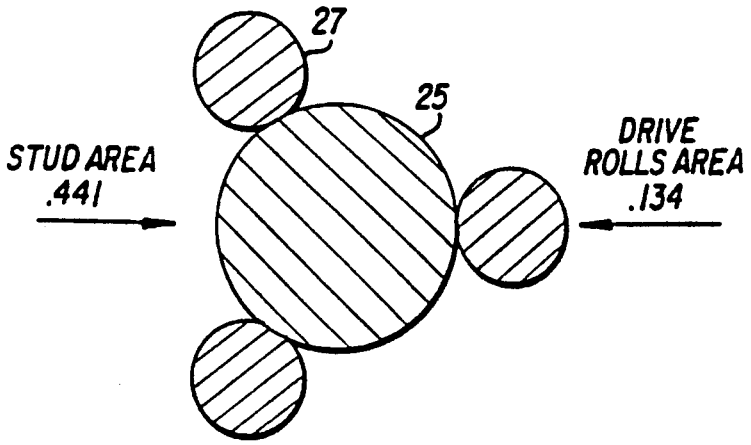
FIG. 8 is a cross-sectional view of the relationship of the cross-sectional area of a non-undercut stud to a cross-sectional area of a roll.
Figure 9:
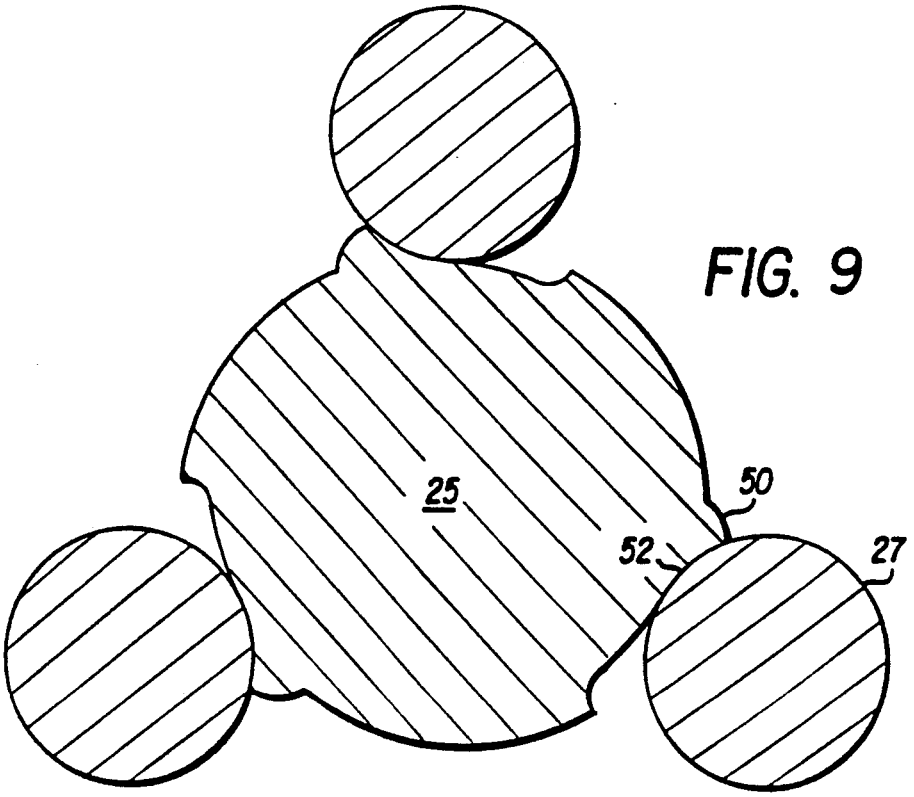
FIG. 9 is a cross-sectional view showing the displacement of material in the non-undercut stud by the rolls.

The prior art roll 27 is illustrated in FIG. 7 in which the roll 27 has a relatively short length 211 of 0.845 inches, a relatively small diameter **27*d* of 0.414 inches and an included angle of 4° (2° on each side). The length to diameter ratio of small rolls is about 2.0. For smaller stud sizes, there is a ratio of about 3 to 1 between the cross-sectional area of the stud 25 and the cross-sectional area of one drive roll 27. For example, as illustrated in FIG. 8, the stud 25 has an area 25*a* of 0.441 $in^2$ and each drive roll 27 has a total cross-sectional area 27*a* of 0.134 $in^2$ at its largest diameter. This relationship was important in stud drivers and removers for small diameter studs because, as illustrated in FIG. 9, as the torque increases, the drive roll 27 starts to penetrate the surface of the stud 25 thus displacing a small amount of material. This material forms a wave 50 in front of the roll 27 and provides a contact surface 52 on which the roll 27 can transmit torque to the stud 25. If this displacement does not occur so that the wave 50** is not formed, or if the wave is insufficient in size, the stud driver and remover will start to slip as the applied torque increases since there is no contact surface on which the roller can transmit torque to the stud.

Figure 10:
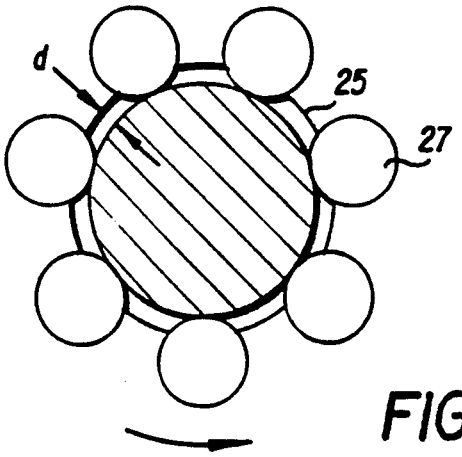
FIG. 10 is a cross-sectional view showing a necked down stud in which the rolls are unable to grasp the non-undercut stud.

As the diameter of the studs increase, the ratio between the cross-sectional area of one roll 27 and the stud 25 becomes insufficient to provide an adequate grip. One conventional solution was to increase the number of drive rolls in each tool, with smaller tools using three rolls and larger tools using up to eleven rolls. This solution was not adequate because the increase in the number of rolls requires a decrease in the angle between the rolls. The decrease in angle between the rolls increases the potential for the roll 27 to "neck down" the diameter of the stud 25 to a size that it will no longer be capable of securely gripping the stud. FIG. 10 illustrates the situation with 7 rolls 27 where each roll is unable to form a wave and create sufficient contact area to grip the stud. In particular, if the number of rolls increases so that the angle between the rolls decreases, when each roll 27 penetrates the stud 25 to a depth "d," there will be insufficient room between the rolls 27 for each stud to form a wave to create its contact area. As a result, the contact area of one roll merges into the contact area of an adjacent roll to neck down the stud so that none of the rolls form a wave or sufficient contact area to grasp the stud.

Figure 11:
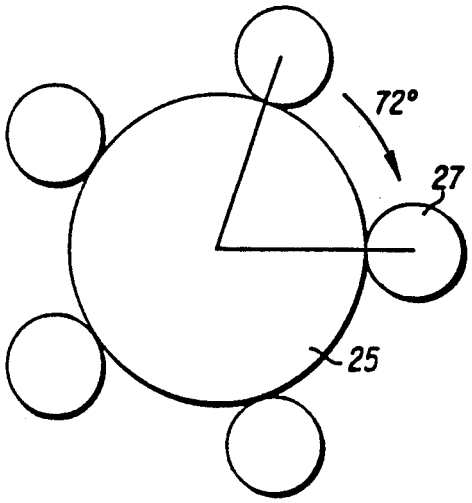
FIG. 11 is a cross-sectional view of five rolls acting on one non-undercut stud.

In accordance with one aspect of the invention, experiments by the inventor have shown that the optimum number of rolls for stud sizes in excess of 1.25 inches in diameter is five rolls as illustrated in FIG. 11. The use of five rolls places the rolls 72° apart which is adequate to prevent the stud from being necked down.

While it is desirable to maintain the 3 to 1 ratio between the cross-sectional area of the stud and the drive roll for small studs, that ratio is unreasonable for larger studs. For example, if this ratio were rigidly applied, a tool for use on six inch diameter studs would require a roll diameter of 1.732 inches, thereby rendering the tool prohibitively large for most applications. Therefore, in accordance with another aspect of the invention, with the number of rolls being five in accordance with the first aspect of the invention, tools for large diameter studs include a cross-sectional area ratio of five to one. This increased ratio increases the contact area and allows the roll to penetrate deeper into the stud thereby obtaining a more secure grip and readily removing the large diameter stud.

The inventors have also determined that the removal of large diameter studs is obtained when the amount of material displaced by the five rolls (equal to five times the cross-sectional area of the wave 50 in FIG. 9) is equal to or greater than the cross-sectional area of the stud. By satisfying this criteria, in addition to the use of 5 rolls and maintaining the 5 to 1 cross-sectional area ratio, tools have been produced which are capable of grasping large diameter studs and applying sufficient torque to the stud to rotatably remove the stud from the workpiece.

In addition to determining the optimum number of rolls, roll spacing and amount of material displacement, the inventors have also determined that several other factors can be varied in designing the tool of the present invention to improve the gripping ability of the tool. These other factors include varying the included angle of the cam, the overall length of the roll, the roll diameter, the overall length of the cam and the cam radius.

Changing the included angle of the roll inhibits "cam out". For example, as torque is applied to the tool, the force is transmitted to the roll 27 and the majority of this force is then transmitted to the stud 25. A small portion of the force is expended in trying to force the roll 27 to walk out of the cam 30, which is an unloading action known as "cam out". The larger the included angle of the roll, the greater the tendency to cam out. While the cam out action can be overcome by exerting an opposing force on the main ring 12, it is often impossible for the operator to exert such an equal and opposite force on the main ring as the torque increases.

To eliminate the cam out problem, it is possible to eliminate the included angle of the rolls. However, this solution is unsatisfactory because as the angle approaches 0°, the tendency is for the rolls to jam against the cam and inhibit the relatively easy removal of the tool at the completion of its cycle. It has therefore been determined that an optimum included angle is 2° which provides sufficient resistance to cam out while still allowing easy removal of the tool from the stud.

Figure 12A:
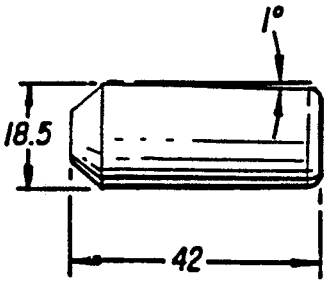
FIGS. 12A and 12B are side views of two rolls used in the tool in accordance with the present invention.
Figure 12B:
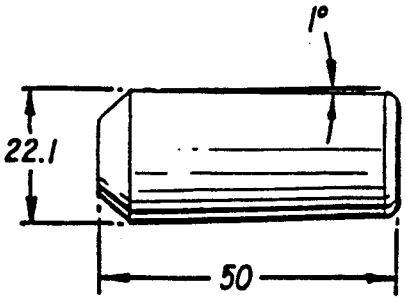

FIGS. 12A and 12B illustrate two inventive drive rolls for removing large diameter studs. The drive roll of FIG. 12A has a length X1 of 42 mm and diameter Y1 of 18.5 mm, while the FIG. 12B drive roll has a length X2 of 50 mm and diameter Y2 of 22.1 mm. The rolls have increases length and diameter over the prior art rolls for small diameter studs because the ratio of roll length to diameter is increased to 2.25 in the inventive rolls. Further, the included angle is set at 2° (1° on each side) to resist cam out while still allowing easy removal of the tool from the stud.

Figure 13:
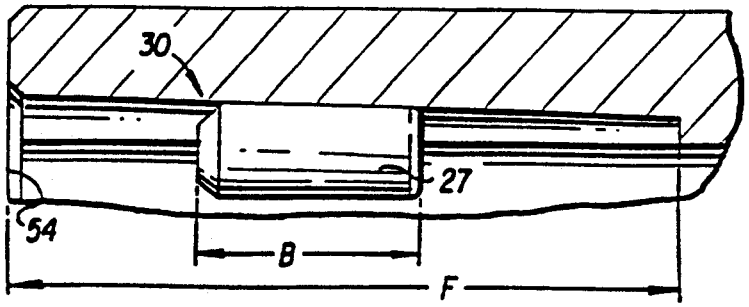
FIG. 13 is a cross-sectional view of a core showing a cam and roll for the tool of the present invention.

In varying the overall length and diameter of the rolls, it is critical that the roll have the ability to displace a sufficient amount of material to insure proper gripping strength. Increasing the overall length of the roll allows an increased amount of length of the stud to be grasped, thereby providing an increased gripping surface and increased gripping ability. Also, with the increased gripping surface of the rolls on the stud, the rolls can displace more stud material to increase the gripping strength. Similarly, increasing the diameter of the roll permits the core and main ring to be modified to be able to accept a much broader variance in stud size than that which was previously available with smaller diameter rolls. For example, in the past, each tool size could accept a total variance of ±0.031 inches. The improved stud driver and remover of the present invention accepts a total variance of ±0.075 inches, which is made possible by the increase in play of the increased diameter roll between the cam and the core, and a longer cam 30 which allows full roll contact throughout the range of the tool, as illustrated in FIG. 13. The cam 30 is also shallower since its angle will be set at 2° to match the included angle of the roll.

Increasing the cam length also provides for improved gripping strength. The cam length F is increased in the axial direction of the tool thereby permitting the tool to compensate for undersized and oversized studs. Since the roll can move along the cam to either axial end position of the cam, the tool can accept a wider variance in stud diameter, the smaller studs moving the roll up the cam toward the driving adapter (to the right in FIG. 13), and the larger studs moving the roll down the cam toward the core cap 54 (to the left in FIG. 13). In the prior art stud driver and remover, the ratio of cam length F to roll length B was about 1.5 to 1, while in the present invention the ratio of cam length F to roll length B is increased to about 2.5 to 1.

Increasing the cam radius also provides for improved gripping ability of the tool of the present invention. As described previously, the increase in roll size allows for an increase in a diameter of the main ring. By altering the size of the main ring and the rolls but always using five rolls per tool, the angle between the rolls remain constant at 72 degrees and the area between the rolls increases in direct relationship to the size of the stud that the tool is designed to remove. The increase in area between the rolls allows for larger cams to be formed on the main ring. The larger cams allow for the cams to be formed with a more gradual angle. For example, if a 1 inch cutting tool is used to form the cams in the bore, a sharp angled cam is formed, whereas if a 2 inch cutting tool is used, the cams are formed with the same amount of depth but have a more gradual angle. This more gradual angle allows more torque to be applied to the stud without having the rolls slip and loose their grip on the stud. The inventors have determined the method described in the following paragraphs yields the optimum cam size.

Figure 14:
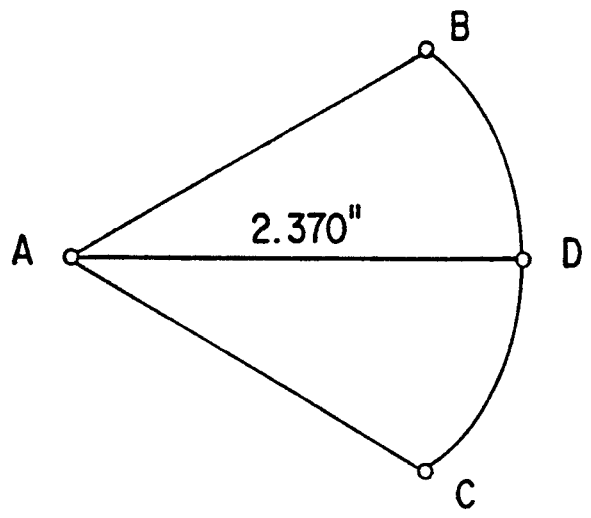
FIG. 14 is a schematic view of three lines defining an arc from which a radius for each of the cams of the present invention is determined.
Figure 15:
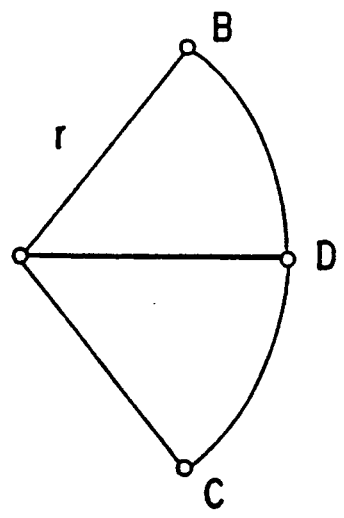
FIG. 15 is a schematic view of the radius determined from the arc of FIG. 14.

To determine a radius for each of the cams, the inner diameter of the tool for a particular stud size is determined. A circle having a diameter equal to the inner diameter of the tool is drawn. Then, two lines equal to the radius of the circle are drawn such that the lines are 60 degrees apart and emanate from a center point of the circle. As seen in FIG. 14, the first line is line AB and the second line is line AC. A third line AD is then drawn from the center of the circle such that the line is directly between the other two lines, i.e. 30 degrees apart from line AB and line AC. The length of line AD is equal to the sum of the radius of the stud being driven and removed and the diameter of the rolls used in this particular size tool. The three points B, D and C define an arc BDC starting at point B, passing through point D and ending at point C. Then a radius of arc BDC is determined according to known mathematical equations or by using a CAD system. The radius of the cams is set to be equal to the determined radius r of arc BDC as seen in FIG. 15.

These various alterations in forming the tool of the present invention increase the gripping ability and overall performance of the tool. Further, these alterations permit each tool to accept a stud variance of 0.15 inches, thereby permitting tools to be produced in 1.25 increments instead of the current 0.063 inch increments. This means that only forty different tools would be needed to cover every conceivable stud size between one and four inches as opposed to eighty sizes using prior art designs. This change reduces inventory, improves the ability to deliver tools in a timely fashion, and saves customers money since customers do not have to purchase as many sizes to cover their needs.

Another aspect of the invention is directed towards the use of impact tools and their affect on prior art stud drivers and removers. When impact tools are used to power prior art stud drivers and removers, shock waves are sent from the drive tool through the main ring, the shock being transmitted to the rolls and the rolls tending to transmit the shock to the stud in the core. In the past, the shock wave tends to break the core cap 54 from the core 17. Once the core cap 54 is broken, the rolls fall free from the tool thus disabling the tool. To overcome this problem, it has been suggested to use a two piece core in which the core cap was brazed or welded in place. Neither the brazed nor welded caps provided sufficient increased strength. Set screws were therefore provided to secure the brazed cap to the core by locating the set screws in the lands between the openings for the rolls. While this cap proved to be more durable, the caps were still subject to premature failure when used on impact tools. One piece cores have been produced in the prior art, but these one piece cores were cast cores which required the pouring of molten metal into a mold to create the core. This process was expensive.

Figure 16:
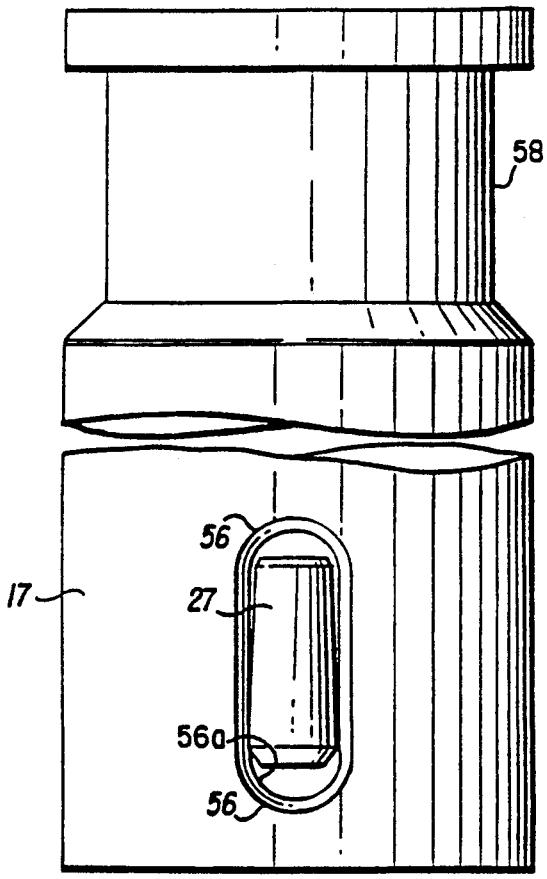
FIG. 16 is a side view of a core having rounded corner slots for the tool in accordance with the present invention.

In accordance with the invention, the core 17 is a one piece core cut from bar stock in which the slots for the rolls are produced with a ball mill to create rounded slots 56 as illustrated in FIG. 16. The slots are formed using a ball mill which is larger than the diameter of the rolls 27. The ball mill does not penetrate all the way through the core which results in the formation of a lip 56*a*. The lip 56*a* has an inner diameter less than the diameter of the rolls so that the rolls do not fall radially inward into the core. The main ring 12 prevents the rolls from falling radially outwardly from the tool. The use of the one piece core with the ball mill produced slots produces a core with strong rounded corners that are more capable of absorbing and distributing the shock waves created by impact drivers. In particular, the shock wave dissipates better in the rounded corner core because there are no straight angled corners in which the stress concentrates. The core member 17 is also easier, cheaper and faster to produce.

The previously described devices are used mainly for studs having a uniform diameter along the axial length of the stud without any non-grip areas or areas not suited for the gripping pressure of the rolls 27. While the previously described tools can be adjusted to adjust the gripping position of the rolls 27 along the axial length of a stud to avoid non-grip areas, the stud being gripped must have a uniform diameter along the axial length. If the stud has portions with varying diameters, the previously described tools often cannot fit over the larger diameter portions. Even if the previously described tools can fit over a larger diameter non-grip portion, the rolls of the tool contact the non-grip area of the stud with such force that the non-grip area, such as a thread or flange, is usually damaged and the stud is rendered unusable. Thus, in the previously described devices, there is no way to prevent damage to the larger diameter portion area because the rolls of the previously described tools can only be adjusted axially along the length of the stud and not radially.

For purposes of example only, the operation of the previously described devices and a further embodiment of the present device will be described in terms of use on an undercut stud but the description of the further embodiment of the present invention being used on an undercut stud should not be considered limiting. The tool to be described below can be used on any stud having a non-grip area that is susceptible to damage by a stud driving and removing device.

Figure 17:
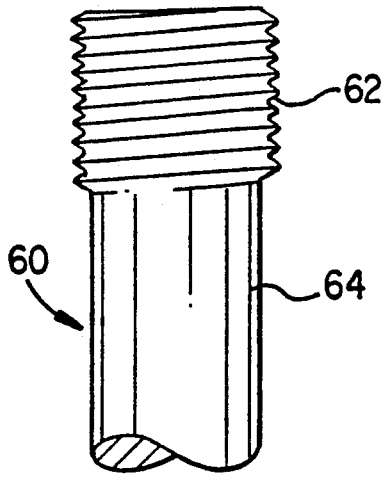
FIG. 17 is a schematic view of an undercut stud.

As seen in FIG. 17, an undercut stud 60 has a relatively large diameter portion 62 at the end thereof and a relatively small diameter undercut portion 64 located below the large diameter portion 62. The small diameter portion 64 is not threaded and is much smaller than the large diameter portion 62. The large diameter threaded portion 62 is a non-grip portion of stud 60 because if the threads are damaged, the stud is unusable. Because the small diameter portion is not threaded, this is the portion of the stud 60 that should be gripped by rolls 27. However, when positioning any of the previously described tools over the stud 60 and driving or removing an undercut stud 60, rolls 27 contact the threaded portion 62 with sufficient force to completely flatten the threads, thereby rendering the stud 60 unusable. These studs have to be replaced at a very large cost per stud.

Figure 18:
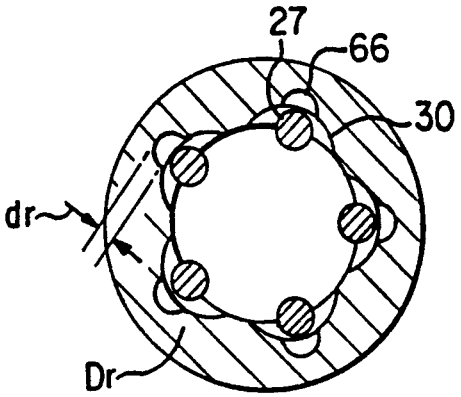
FIG. 18 is a top view of a main ring having the cams and recesses in accordance with a further embodiment of the present invention.

To overcome the above problem, another embodiment of the present invention seeks to provide a tool for removing undercut studs and other studs having non-grip areas that allows for sufficient radial travel of rolls 27 so that the rolls 27 can pass over the large diameter portion 62 and yet still be able to firmly grasp the small diameter non-threaded portion 64 without damaging the large diameter portion. The present invention solves the above described problem by providing a recess 66 in each of the cam surfaces 30 as seen in FIG. 18. Each recess 66 is preferably located in the center of each of the cam surfaces 30 in the rotary direction and has a radial depth $d_r$ equal to or greater than 50% of the difference between a diameter of the larger diameter portion 62 and a diameter of the small diameter portion 64. Each recess 66 may also be preferably formed with a diameter $D_r$ which is greater than the major diameter of each roll 27.

Figure 19:
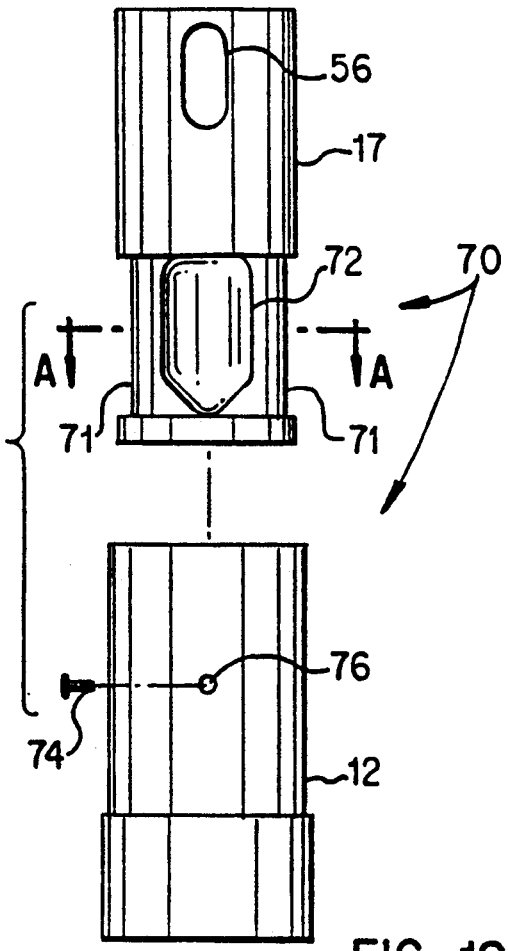
FIG. 19 is a side view of the core and main ring of the embodiment of FIG. 18.

As seen in FIG. 19, the tool of the present invention is also provided with a centering device 70 for each roll 27. Each centering device 70 forces each roll 27 to return to the center of each cam 30 when the tool is in a relaxed or unloaded position. By forcing each roll 27 to the center of each cam 30, rolls 27 enter recesses 66 allowing for the tool to slip over the larger diameter portion 62 of stud 60 such that rolls 27 barely contact threaded portion 62. Thus, the threads on portion 62 are not flattened or even affected by inserting the tool on the stud 60.

Figure 20:
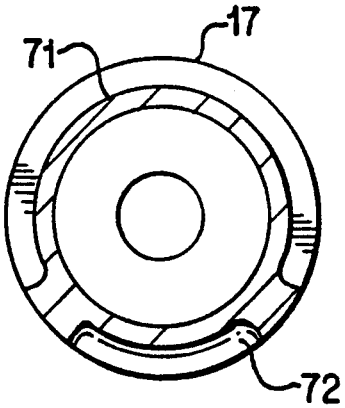
FIG. 20 is a section view along line A—A in FIG. 19 of the core of the embodiment of FIG. 18.

The centering device 70 comprises a self-centering window 72 located in core 17 and a set screw 74 located in a hole 76 in main ring 12 shown in FIG. 19. The core 17 shown in FIG. 19 differs from the core 17 shown in FIG. 16 in that the core 17 in FIG. 19 does not have the reduced diameter portion 58 extending around the entire circumference of the core 17 located above slot 56 in FIG. 16. Instead, core 17, as shown in FIGS. 19 and 20, has a reduced diameter portion 71 extending around only a portion of the circumference thereof and a self-centering window 72 formed in axial alignment with slot 56. As in the previously described devices, set screw 20 fits into the reduced diameter portion 72 to prevent the core 17 from falling out of the main ring 12.

Figure 21:
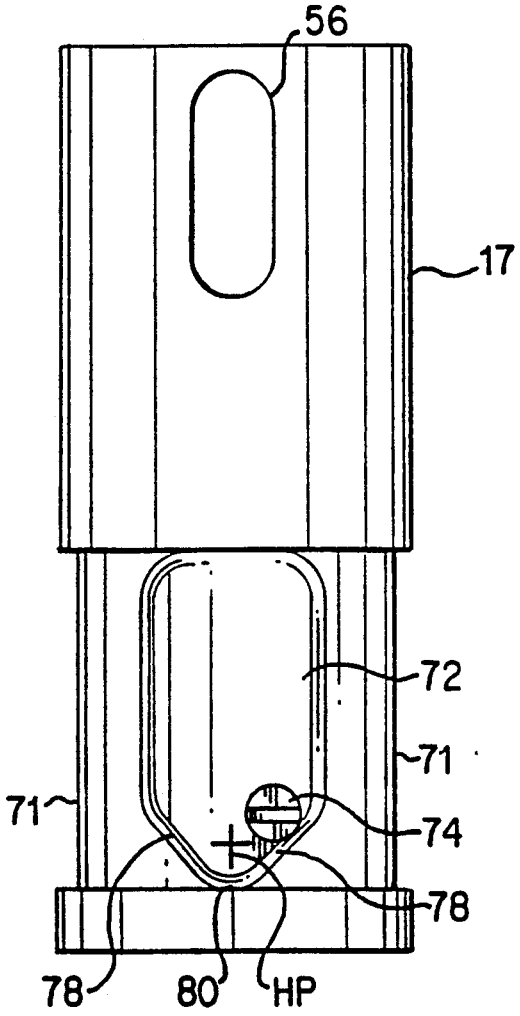
FIG. 21 is a side view of the self centering window in accordance with the embodiment of FIG. 18.
Figure 22:
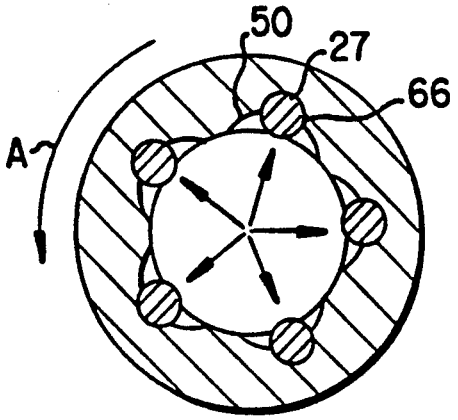
FIG. 22 is a top view of an unloaded position of the tool of FIG. 18.

In one of the inventive features of the present embodiment, each of the set screws 74 sits in the hole 76 and rides within window 72 to limit the axial and radial travel of the core 17. As the core 17 approaches the relaxed and unloaded position, each set screw 74 contacts one of the angled sides 78 of each self centering window 72 as seen in FIG. 21. This forces the core 17 to turn slightly until the core 17 gradually reaches the home position HP located at the intersection or vertex 80 of the angled sides 78. The home position HP locates the rolls 27 opposite the recesses 66. Once the core reaches HP, centrifugal forces cause rolls 27 to move outwardly into recesses 66 as soon as the tool is rotated in the direction of arrow A as shown in FIG. 22.

In operation, the tool is fitted on an undercut stud 60 by locating each of the rolls 27 located in recesses 66 thereby enabling the tool to be easily positioned over larger diameter portion 62 because the rolls 27 move radially outwardly into the recesses 66 to avoid interference with the larger diameter portion 62. Once rolls 27 are located below larger diameter threaded portion 62, the tool can be rotated as described in the operation of the ROLL-GRIP TM device to bring rolls 27 into contact with stud 60. When the tool is rotated into locking position, cams 30 force rolls 27 out of recesses 66 and into locking engagement with stud 60. Once the tool is locked, the stud 60 can be driven or removed without affecting the threaded portion 62. When driving or removing of the stud 60 is complete, the tool is moved rearwardly away from stud 60 causing the core 17 to approach the relaxed or unloaded position and the set screws 74 to contact the angled sides of the self centering windows 72. Then, the core 17 turns slightly until the core 17 reaches the home position HP and the centrifugal force causes rolls 27 to enter recesses 66. Since the rolls 27 are located in recesses 66, the tool can be removed from the stud 60 without the rolls 27 damaging the threaded portion 62.

The invention has been described above in detail with reference to its preferred embodiments, which are intended to be illustrative and non limiting. Various changes and modifications may be made without departing from the spirit and scope of the invention as defined in the following claims.

What is claimed is:

1. A tool driven by a driving adaptor for driving and removing a stud relative to a workpiece, the stud having a longitudinal axis and diameter measured in a transverse direction perpendicular to the longitudinal axis of the stud, the tool comprising:

a main ring with an axial bore along its central longitudinal axis, one end of the bore being located adjacent the driving adaptor and the opposite end having an outwardly tapering section;

a core member mounted within the bore for limited axial and rotary movement relative to the main ring;

a plurality of tapered rolls each having a longitudinal axis and being carried by the core member, each of said plurality of rolls cooperating with the outwardly tapering section of the bore for frictionally engaging the stud upon axial movement of the core toward the one end of the bore and for releasing the stud upon axial movement of the core toward the opposite end of the bore;

a plurality of axially extending cam surfaces formed on the outwardly tapering section of the bore, wherein each of said plurality of cam surfaces is provided for a corresponding one of said plurality of rolls to lock each of said plurality of rolls against the stud upon rotation of the core member relative to the main ring in a radial direction, each cam surface having a first portion extending radially inward toward the central axis and a second portion extending radially outward from the central axis, wherein each of said second portions of said plurality of cam surfaces has a recess formed therein extending radially outward from the central axis to accommodate the corresponding one of said plurality of rolls.

2. The tool of claim 1, wherein each recess is formed in a center of each of said second portions of said cam surfaces in the rotary direction.

3. The tool of claim 1, wherein a stud being driven and removed has a larger diameter portion and a smaller diameter portion and each recess is formed with a radial depth of not less than 50% of a difference between a diameter of the larger diameter portion and a diameter of the smaller diameter portion.

4. The tool of claim 1, wherein each recess is formed with a diameter greater than a major diameter of one roll.

5. The tool of claim 1, further comprising:

a plurality of holes formed in said main ring;

a plurality of slots formed in said core member for holding said rolls in a predetermined position;

a centering device provided for each roll comprising:

a centering window provided in said core member;

a set screw provided in one of said holes in said main ring; wherein each of said centering windows is formed in axial alignment with one of said slots and each of said set screws is provided in axial alignment with one of said centering windows.

6. The tool of claim 1, wherein the plurality of rolls includes five rolls.

7. The tool of claim 3, wherein a ratio of the cross section area of the stud taken in the transverse direction of the stud to a corss sectional area of one roll taken in a transverse direction of said one roll is about 5 to 1, wherein said smaller diameter portion of the stud is used to determine the cross sectional area of the stud.

8. The tool driven by a driving adaptor for driving and removing a stud relative to a workpiece, the stud having a longitudinal axis and diameter measured in a transverse direction perpendicular to the longitudinal axis of the stud, said stud having a larger diameter non-grip area at an end thereof and a smaller diameter grip area adjacent said non-grip area, the tool comprising:

a main ring with an axial bore, one end of the bore being located adjacent the driving adaptor and the opposite end having an outwardly tapering section;

a core member mounted within the bore for limited axial and rotary movement relative to the main ring;

a plurality of tapered rolls each having a longitudinal axis and being carried by the core member, each of said plurality of rolls cooperating with the outwardly tapering section of the bore for frictionally engaging the stud upon axial movement of the core toward the one end of the bore and for releasing the stud upon axial movement of the core toward the opposite end of the bore;

a plurality of axially extending cam surfaces formed on the outwardly tapering section of the bore, wherein each of said plurality of cam surfaces is provided for a corresponding one of said plurality of rolls to lock each of said plurality of rolls against the stud upon rotation of the core member relative to the main ring in a radial direction, each cam surface having a first portion extending radially inward toward the central axis and a second portion extending radially outward from the central axis, and means for allowing said rolls to move radially outwardly when said rolls contact said larger diameter non-grip area to prevent damage to said non-grip area, said allowing means being located in the second portion of said cam means.

9. The tool of claim 8, wherein said non-grip area is a larger diameter threaded portion and said grip area is a smaller diameter non-threaded portion, each of said cam means having a center point in said radial direction and said means for allowing said rolls to be forced radially outwardly comprises:

recess means provided at said radial center point of each of said second portions of said cam means to receive one of said rolls; and centering means for forcing each of said rolls radially outwardly from a locking position in which said rolls grip said stud to an unloaded position in which said rolls fit in said recess means in said center point of each of said second portions of said cam means.

10. The tool of claim 9, wherein each of said centering means comprises:

a window provided in a hole in said main ring; wherein each of said windows is formed in axial alignment with one of said rolls and each of said set screws is provided in axial alignment with one of said windows.

11. The tool of claim 9, wherein each of said recess means comprises a circular recess formed with a radial depth of not less than 50% of a difference between a diameter of the larger diameter portion of the stud and a diameter of the smaller diameter portion of the stud and a diameter greater than a major diameter of one roll.

12. The tool of claim 8, wherein the plurality of rolls includes five rolls.

13. The tool of claim 8, wherein a ratio of the cross sectional area of the stud taken in the transverse direction of the stud to a cross sectional area of one roll taken in the transverse direction of said one roll is about 5 to 1, wherein said smaller diameter portion of the stud is used to determine the cross sectional area of the stud.

* * * * *